US005507489A

United States Patent [19]

Reibel et al.

[11] Patent Number: 5,507,489

[45] Date of Patent: Apr. 16, 1996

[54] ELECTRONIC GAME-OF-CHANCE DEVICE

[75] Inventors: Jean-Michel Reibel, Lamptertheim; Pierre-Luc Simon, Wasselonne; Eric Bigonneau, Paris; Jean-Etienne Bouedec, Charenton, all of France

[73] Assignees: Info Telecom, Vendenheim; La Francaise Des Jeux, Neuilly-sur-Seine, both of France

[21] Appl. No.: 129,928

[22] Filed: Sep. 30, 1993

[30] Foreign Application Priority Data

Nov. 4, 1992 [FR] France ..... 92 13239

[51] Int. Cl.[6] ..... A63F 9/24

[52] U.S. Cl. ..... 273/138 A

[58] Field of Search ..... 273/138 A, 139, 273/143 R, 85 G; 364/412

[56] References Cited

U.S. PATENT DOCUMENTS

| | | | |
|---|---|---|---|
| 4,087,092 | 5/1978 | Krause et al. | 273/138 A |
| 4,206,920 | 6/1980 | Weatherford et al. | 273/138 A |
| 4,322,612 | 3/1982 | Lange | 273/138 A X |
| 4,494,197 | 1/1985 | Troy et al. | 364/412 |
| 4,665,502 | 5/1987 | Kreisner | 364/412 X |
| 4,669,730 | 6/1987 | Small | 273/138 A |
| 4,764,666 | 8/1988 | Bergeron | 273/138 A X |
| 5,054,787 | 10/1991 | Richardson | 273/369 |
| 5,069,453 | 12/1991 | Kozz et al. | 273/139 |
| 5,119,295 | 6/1992 | Kapur | 364/412 |
| 5,259,023 | 11/1993 | Katz | 379/88 |

FOREIGN PATENT DOCUMENTS

| | | |
|---|---|---|
| 0450520A2 | 10/1991 | European Pat. Off. . |
| WO89/02139 | 3/1989 | WIPO . |
| WO91/06931 | 5/1991 | WIPO . |

*Primary Examiner*—Jessica J. Harrison
*Attorney, Agent, or Firm*—Robbins, Berliner & Carson

[57] ABSTRACT

A portable box comprises memory able to store at least one item of reference data, and a comparator able to compare the said reference data item with an item of game data input by the player via a communication interface, one of these two data items being a value generated in a random way. An item of win information dependent at least on the result of the said comparison is stored in the memory, and box encryption structure are able, in response to a predetermined item of payment request information (IDP) received, to establish a first encrypted win value from the said win information item. A station, external to the box, comprises a system input/output interface able to cooperate with the interface of the box, and system processing structure, able, in the presence of a payment request originating from the player, to read the said win information item contained in the memory of the box. System encryption structure, counterparts of the box encryption structure, establish a second encrypted win value from the said win information item read. The actual payment of the win to the player is conditioned by agreement of the two encrypted win values.

36 Claims, 10 Drawing Sheets

FIG.1

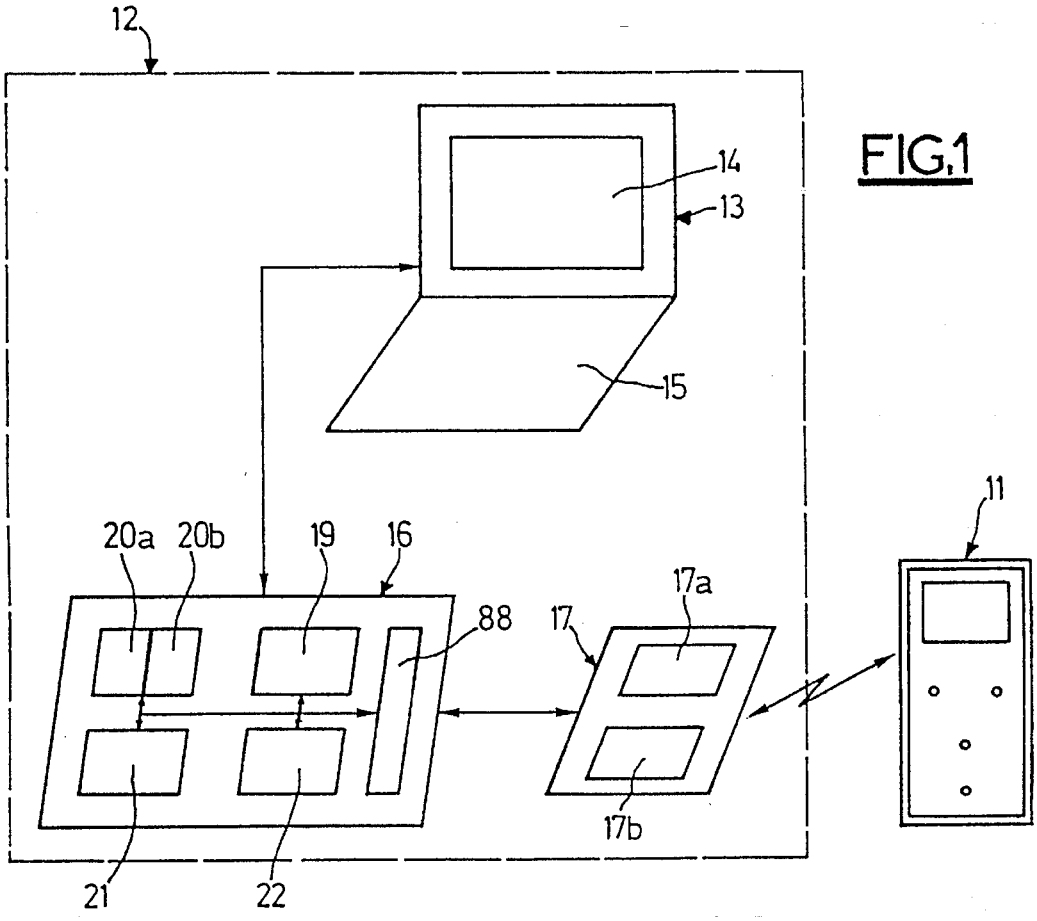
FIG.1
FIG.2
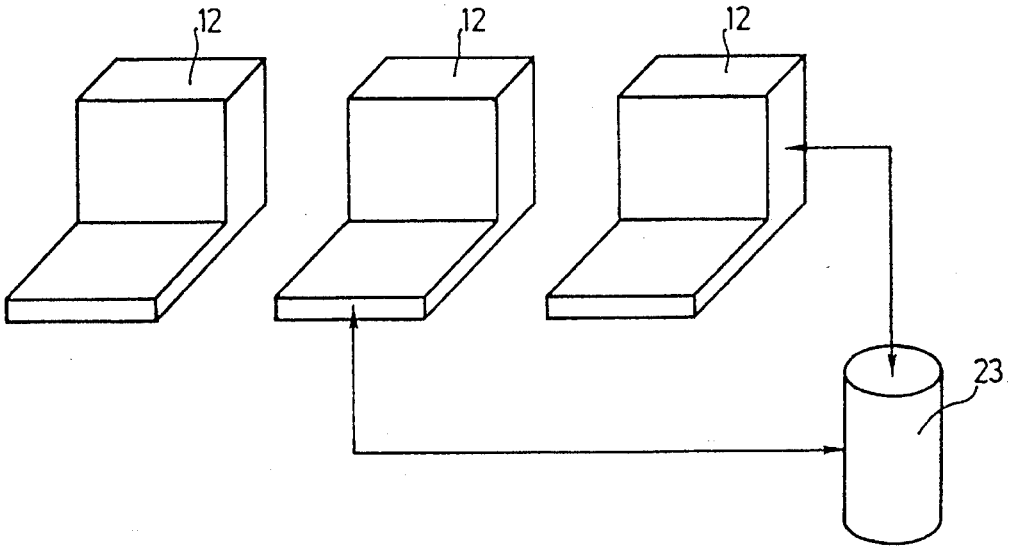

PAYER
STATION
BOX

1
OK?
NO
YES
82
ANOMALY
84
WINNING LIST VERIFICATION
YES
WIN > GS?
83
NO
86
SENDING IDP AND MBA
OK?
YES
NO
ANOMALY
85
87
RECEPTION IDP + MBA
88
89
READ M1 AND 50
READ M1 AND MBA
90
91
INITIAL VALUE 46
COUNTER INITIAL VALUE 45
92
PSEUDO-RANDOM GENERATION
VF1
93
SENDING VF1
94
VF1 RECEPTION
2

PAYER
STATION
BOX 2
95
CALCULATE M1 CONTENTS
96
CALCULATE VF2
97
VF1 ≟ VF2
NO
YES
ANOMALY
99
PAYMENT
101
BOX LOCKED
ARCHIVING
100
END
END

ELECTRONIC GAME-OF-CHANCE DEVICE

BACKGROUND OF THE INVENTION

The invention relates to an electronic game-of-chance device.

Various games of chance are currently known allowing a player to win sums of money by virtue of the payment of an initial stake. Thus, for example, in the game called "lotto" (registered trademark) the player takes a series of figures on a ticket which he has checked by a dedicated body, paying over a price therefor corresponding to the initial stake. A subsequent draw is carried out under controlled conditions in a chosen place and the winners in possession of a winning ticket can collect their win from a paying body.

With respect to these conventional games, requiring a paper medium and draws at predetermined dates which are valid for all the players, the invention proposes a radically different concept of a game-of-chance device.

OBJECTS AND SUMMARY OF THE INVENTION

An object of the invention is to propose a self-contained and portable box intended to allow a player to have one or more turns at a game of chance, the success or the failure of the said turns conditioning a score or a level of win according to predetermined rules of the game. This box then also constitutes the transaction element for payment of the win and includes all the elements necessary for verification of this win. In addition to this portable and self-contained box, a control system is provided for, external to the box, allowing the paying body to carry out necessary verifications before payment of the win.

The object of the invention is also to make it possible to carry out within the electronic box itself the draw of the reference data with respect to which the game data chosen by the player will be compared. The invention also aims to allow the simulation of one or more throws of dice, by carrying out, within the box itself, a draw of the game data which will be compared with predetermined reference data.

A very important problem, inherent in such a gaming device, consists in combating fraud. To this end the object of the invention is also to provide several levels of security and of verification dealing as much with the origin of the portable box as with the contents of its information relating, on the one hand, to the "lost" or "won" state of the game, and, on the other hand, to the value proper of the win accumulated by the player, a value which can be very large.

Hence the invention proposes an electronic game-of-chance device comprising a) a portable box comprising
- a box input/output interface able to receive a predetermined item of game authorization information without which the box is Unable to be played,
- an interface for communication with the player,.
- memory means able to store at least one item of reference data,
- box processing means, including
  - comparison means able to compare the said reference data item with an item of game data inserted by the player via the communication interface, one of these two data items being a value generated in a random way,

- means able to establish an item of win information depending at least on the result of the said comparison, and to store this win information item in the memory means, and
  - box encryption means, able, in response to a predetermined item of payment request information received via the box input/output interface, to establish a first encrypted win value from the said win information item and to deliver this first encrypted value to the box interface, and b) a control system, external to the box, comprising
- a system input/output interface able to cooperate with the box input/output interface, and
- system processing means, able,
  - in the presence of a payment request originating from the player, to read the said win information item contained in the memory means of the box and to deliver the said payment request information item to the system input/output interface, and including
  - system encryption means, counterparts of the box encryption means, able to establish a second encrypted win value from the said win information item read, as well as comparison means able to compare the two encrypted win values; the actual payment of the win to the player is then conditioned at least by agreement of the two encrypted win values.

The person skilled in the art knows that the term "random" associated here with the generation of an item of reference data or of an item of game data, is in a general way a mathematical concept, and that the physical production of "random" generation means makes this generation pseudo or near random, even if in practice it is impossible to predict in advance the data item having been generated. The term "random" is nevertheless used here in order to express the practical impossibility for a third party to predict in advance the game data item or the reference data item.

According to one embodiment, the system processing means are able to transmit the said predetermined game authorization information item. Moreover, so as to read the win information item, the system processing means are able, in the presence of a payment request originating from the player, to transmit a status request to the system input/output interface, in response to which the box processing means deliver the said win information item to the box input/output interface.

According to one embodiment, the box processing means include first random generation means able randomly to generate the said reference data item among a predetermined set of values, while the communication interface includes data inputting means allowing the player to choose his game data item from among the same predetermined set of values.

In order to provide the random character of the draw of the reference data, the first random generation means advantageously include at least one game counter operating from an initial instant preceding the reception of the said predetermined game authorization information item, this counter being capable of being stopped on reception of a chosen item of stop information and of memorizing the value which it exhibits upon stopping its operation, this stopping value defining the said reference data item.

The stop information item is preferably the said game authorization information item.

In a variant, it is possible to design a game in which the reference data items are, for example, constants fixed by the rules of the game, the game data items having to be chosen randomly by the player in a manner analogous to a throw of dice. In such a variant, the box processing means may include second random generation means, controlled by the action of the player and able randomly to deliver the said game data item, the reference data item being a predetermined item of data stored in the memory means.

In order to provide better security in verification of the win information item, the memory-means are able to store a first item of predetermined auxiliary data, and the box encryption means are able to generate the first encrypted win value from the said win information item and from the said first auxiliary data item.

The first auxiliary data item is advantageously obtained from a first auxiliary encryption of at least one first item of information specific to the box such as its serial number, and is present in the memory means before reception of the game authorization information item.

According to one embodiment, the box encryption means include:

a pseudo-random win encryption generator able to be initialized by an initial value and to operate until reception of a stop indication, the first encrypted win value then being the value delivered by the pseudo-random win encryption generator upon reception of the said stop indication, a first logic circuit able to receive, as input variables, the said win information item and at least a part of the first auxiliary stored data item to apply a first predetermined logic function to these two input variables and to deliver a first corresponding output value, defining the said initial value of the pseudo-random win encryption generator, and an auxiliary counter able to count up or count down from a counter initial value to a counter final value, the said indication for stopping the operation of the pseudo-random win encryption generator being delivered by the auxiliary counter when the said counter final value is reached.

The box encryption means also preferably comprise a second logic circuit able to receive, as input variables, a pseudo-random binary word and at least a second part of the first auxiliary stored data item, to apply a second predetermined logic function to these two input variables and to deliver a second corresponding output value, defining the said counter initial value or the said counter final value.

The system processing means advantageously comprise system pseudo-random generation means able to generate the said pseudo-random binary word, this pseudo-random binary word accompanying the said payment request information item.

So as to carry out verification of the first encrypted win value, the system processing means include first auxiliary encryption means able to carry out the said first auxiliary encryption of the said first specific information item in order to recalculate the value of the first auxiliary data item; moreover, the system encryption means include means analogous to those of the box encryption means and are able to determine the second encrypted win value from the value of the first, recalculated, auxiliary data item and from the pseudo-random binary word. This second encrypted win value will then be compared with the first.

In order to carry out another verification before payment, the memory means are, advantageously able to store a second, predetermined, auxiliary item of data, and, in the presence of the payment request originating from the player, the system processing means are able to carry out a verification processing of the value of this second auxiliary data item before delivering the said payment request information item to the box. This second auxiliary data item may be a certificate by a secret or public key coding algorithm of an authenticator specific to the control system, such as the serial number of a sales terminal.

In order to verify the origin of the box, it is advantageously provided for that the memory means are able to store an item of authentication data of the box before reception of the said game authorization information item; the reception of the said game authorization information item is conditioned by verification of this authentication data item.

This authentication data item may result from an authentication encryption of a third item of information specific to the box; it may involve a certificate of the serial number of the box obtained by a secret or public key encryption algorithm using a key other than that provided for the second auxiliary data item.

The system processing means therefore preferably include authentication encryption means able to recalculate the authentication data item from the third specific information item in order to verify the value of this third specific information item read in the memory means.

The serial number of the box may be present in the memory means of the box. It may also be read by an appropriate reading means, for example by an optical reader if the serial number appears in the form of a bar code on a label fixed to the box.

According to one embodiment, the memory means include two memories, one of them containing the first auxiliary data item the other first of all containing the authentication data item then, after verification of the latter, the second auxiliary data item.

Moreover, the memory means may include a state counter able to contain an item of state information representative of the result of the game, as well as a payment counter able to contain an item of payment information representing a payment already made or not yet made to the player.

In the presence of the payment request originating from the player, the system processing means are able furthermore to read the contents of the state and payment counters before delivering the said payment request information item to the box.

The box advantageously includes power supply means allowing the operation of at least some of these means, such as the game counters and the memories, before reception of the game authorization information item.

The box is advantageously unable to be played following a comparison between an item of reference data and an item of game data representing a losing game and/or after actual payment to the player.

The communication interface preferably includes means for displaying to the player an item of result information representative of the result of the comparison between the game and reference data items, indicating to him whether he has won or lost.

According to an embodiment of the invention the memory means are able to store a plurality of reference data items, and a plurality of game data items are able robe input by the player.

These game data items may be input successively, each game data item input being compared with a predetermined item of reference data; an item of game data can be input via the communication interface only in the event of agreement between the previously input game data item and the corresponding reference data item, and a different item of win information corresponds to each agreement.

The result information item then advantageously includes the display of an item of win level information corresponding to the win information item contained in the memory means.

The memory means preferably include a win counter able successively to contain predetermined binary win words representing successive win information items, each binary word differing from the following word and from the preceding word by at least two bits. This makes it possible to have binary words which are sufficiently different from one another, so as correctly to differentiate the corresponding win information items and in particular to avoid errors occasioned, for example, by mis-reading or writing of a single bit. Similarly, the state counter is advantageously able successively to contain predetermined binary state words representing successive state information items, each binary state word differing from the following word and from the preceding word by at least two bits.

When several game data items have to be inserted by the player, especially successively, the first random generation means include a plurality of game counters, each counter being capable of containing an item of reference data and is associated with an item of game data input by the player. It can then be provided that reception of the said game authorization information item stops the operation of all the counters, the plurality of reference data items then being the plurality of values which the counters had upon reception of the said game authorization information item. In other words, the draw Of the reference data is carried out once and for all before inputting of the game data items by the player. However, it is possible to provide for a draw to be carried out for each game data item inserted. In this case, a single counter may be associated with all the successive inputs of game data items by the player; the inputting of a game data item by the player then fixes the corresponding counter at a value defining the reference value associated with this game data item.

The control system advantageously includes an interface for dialogue with the player able to receive the said payment request. This dialogue interface may be used for other purposes. Thus, in the presence of a win information item verification request originating from the player, the system processing means may read the contents of the win, state and payment counters and communicate the results of this reading on the dialogue interface.

The control system may include at least one station, such as a terminal, and preferably a plurality of stations of similar structure, the game authorization and payment request information items being able to be delivered by the same station or by two different stations.

So as to carry out another verification, especially when the win is significant, the control system advantageously includes storage means for a list of authenticators of the winning and paid boxes, and in the presence of a payment request originating from the player and corresponding to a win higher than a predetermined win value, the system processing means are able to verify whether the authenticator of the box concerned is already contained in the said list.

The subject of the invention is also a box and a control system belonging to such an electronic game-of-chance device.

BRIEF DESCRIPTION OF THE DRAWINGS

Other advantages and characteristics of the invention will appear on examining the detailed description of an embodiment, which is in no way limiting, and is illustrated in the drawings in which:

FIG. 1 diagrammatically represents a station and a box according to the invention, FIG. 2 illustrates a network of stations.

DETAILED DESCRIPTION OF THE INVENTION

Figure 3C:
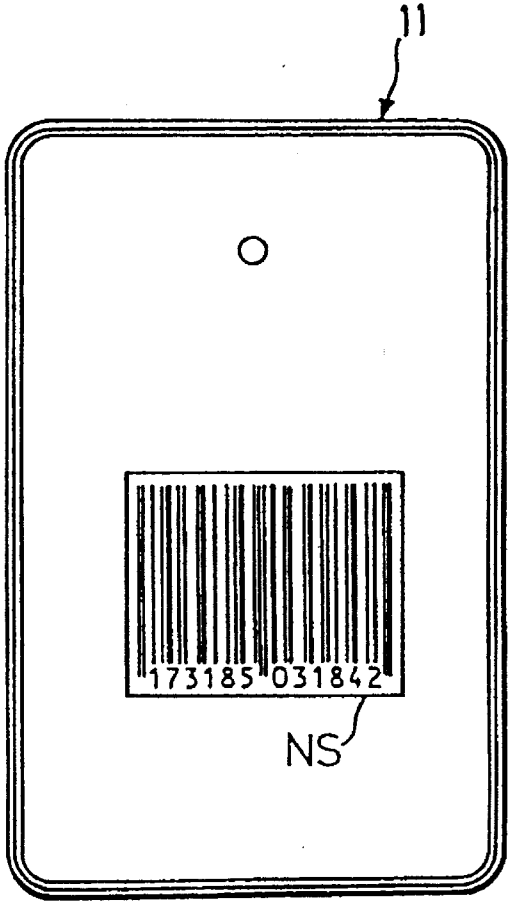
FIGS. 3*a*, 3*b*, 3*c* represent the box of FIG. 1 in more detail.

As illustrated in FIG. 1, the electronic game device includes a portable box 11 and a control system 12, external to the box 11, and comprising a system input/output interface 17, here including two copper regions 17*a* and 17*b* able to cooperate with counterpart copper regions of a box input/output interface for the box 11 so as to carry out an exchange of data via a capacitive coupling.

In addition to this input/output interface 17, the control system 12 includes system processing means 16 connected to this interface 17 as well as to an interface 13 for dialogue with a user such as the vendor or the paying agent. This dialogue interface includes a display screen 14 as well as a keyboard 15 for inputting control information for example.

The system processing means 16 are incorporated within an electronic card structured around a micro-controller carrying on a dialogue with the interface 17 via an input/output register 88. As will be seen in more detail later during the operation of the device the system processing means 16 include system encrypting means 19, first and second auxiliary encrypting means 20*a* and 20*b*, authentication encryption means 21 as well as system pseudo-random generation means 22 able to generate a pseudo-random binary word the significance of which will be explained later. Physically, these various means are represented by software within the microcontroller of the system processing means.

In FIG. 1, the system processing means 16, the system input/output interface 17 and the dialogue interface 13 are physically grouped together within a station such as a terminal. To this end, it is possible to make provision to use a conventional microcomputer, such as, for example, that known by the name PC from the IBM company. In this case, the dialogue interface 13 will include the screen and the keyboard of the microcomputer. It is also possible to provide an additional electronic card which can plug into the microcomputer, incorporating the system processing means, as well as an extension forming the interface 17.

Although, in a general way, the control system can be incorporated within a single station, there is provision to use a network of stations 12 (FIG. 2) all having a similar structure. At least some of these stations may be linked to storage means 23 able, as will be seen in more detail later, to store a list of authenticators of boxes having resulted in a winning game and having given rise to actual payment to the player.

The box 11 has overall dimensions allowing it to be held easily in one hand. It includes, on its front face (FIG. 3*a*), a key 24 allowing power to be applied to activate at least some of the means constituting it, such as, for example, the display screen 28. Moreover, there is provision, in this embodiment example, for three game keys 25, 26 and 27, on which are inscribed respectively three figures (1, 2 and 3) representing three game data items among which the player may make his choice.

On its rear face (FIG. 3*c*) is a label on which there appears, for example in bar code, the serial number NS of the box. This serial number here constitutes a unique authenticator specific to the box.

Figure 3B:
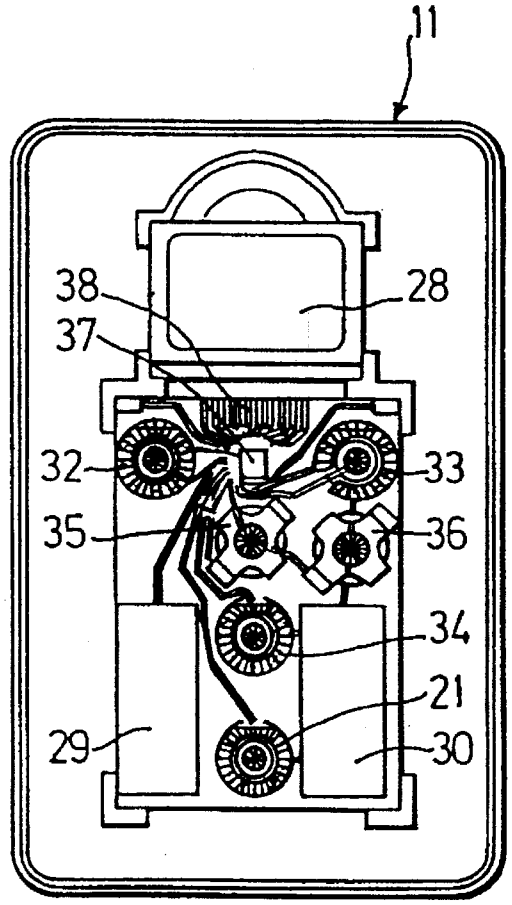
Figure 3A:
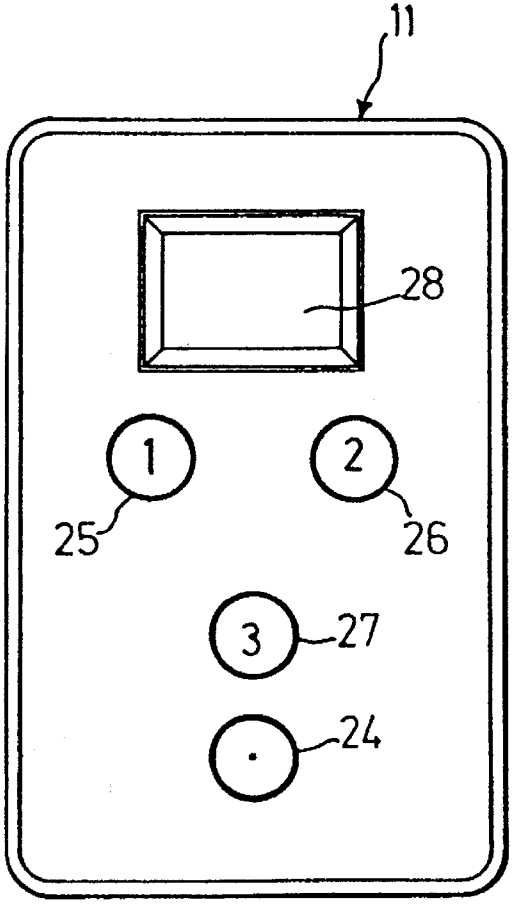

FIG. 3*b* diagrammatically illustrates an internal view of the box 11. The electronic mouldings 21, 32, 33 and 34 of the keys 24, 25, 26 and 27 are seen therein. Two copper regions 29 and 30, forming part of a box input/output interface are able to cooperate with the corresponding two copper regions 17*a* and 17*b* of a station 12. Self-contained power supply means 35 and 36, such as batteries, make it possible to ensure the self-contained nature of the portable box and serve, as will be seen later, to supply some of the components of the box permanently.

Whereas the three game keys 25, 26, 27 and the display screen 28 form an interface for communication with the player, an essential element of the invention consists here of a specific hard-wired integrated circuit (ASIC: Application Specific Integrated Circuit) bearing the reference 37 and incorporating, as will be seen in more detail later, box processing means as well as memory means. This ASIC is linked by a connection network 38 to the game keys, to the power supply means, as well as to the display screen 28. Needless to say, it would have been possible, in place of an ASIC component, to use a microcontroller incorporating, as software, at least some of the functions of the box, which functions will be described below. Nevertheless, the use of an ASIC component allows the production costs to be reduced and increases the security of the device according to the invention, against fraud. It is in fact more difficult, for a fraudster, to gain access and understand the architecture of a wiring scheme which is specifically produced for an application and incorporated within a ASIC, than to gain access to the instructions of a program incorporated within a program memory of a micro-controller.

Figure 4:
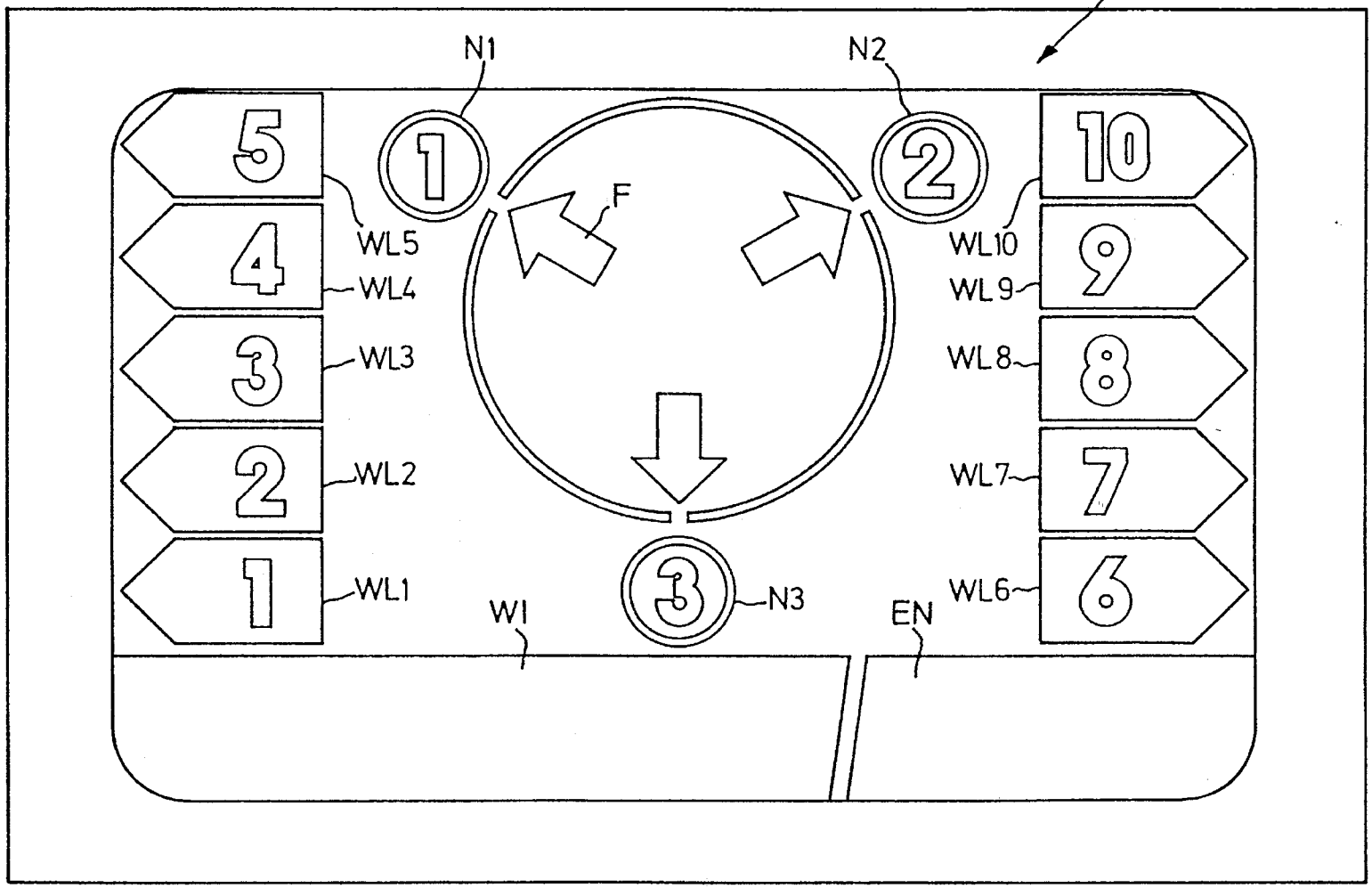
FIG. 4 represents a display screen of the box.

In FIG. 4 a display screen 28 is represented, such as it is likely to appear to the player in the specific game application which is described in this example. At the bottom of the display screen two spaces are provided WI and EN in which the expressions "WIN" and "END" are able to be displayed, according to whether the player has won or lost in his game of chance. On the two lateral edges of the display screen are arranged two columns of locations respectively numbered 1, 2, 3, 4, 5 and 6, 7, 8, 9, 10. These locations bear the references WL1-WL10 and correspond to displays of successive win levels achieved by the player during his game. At the centre of the display screen there appear locations for three arrows F positioned respectively opposite circular locations N1, N2 and N3 within which are represented the three FIGS. 1, 2 and 3. As will be seen later, one of these arrows F will represent the choice by the player after the latter has pressed one of the game keys 25 to 27 while one of the locations N1, N2 or N3 will represent the reference data item drawn at random by the box itself.

Figure 5:
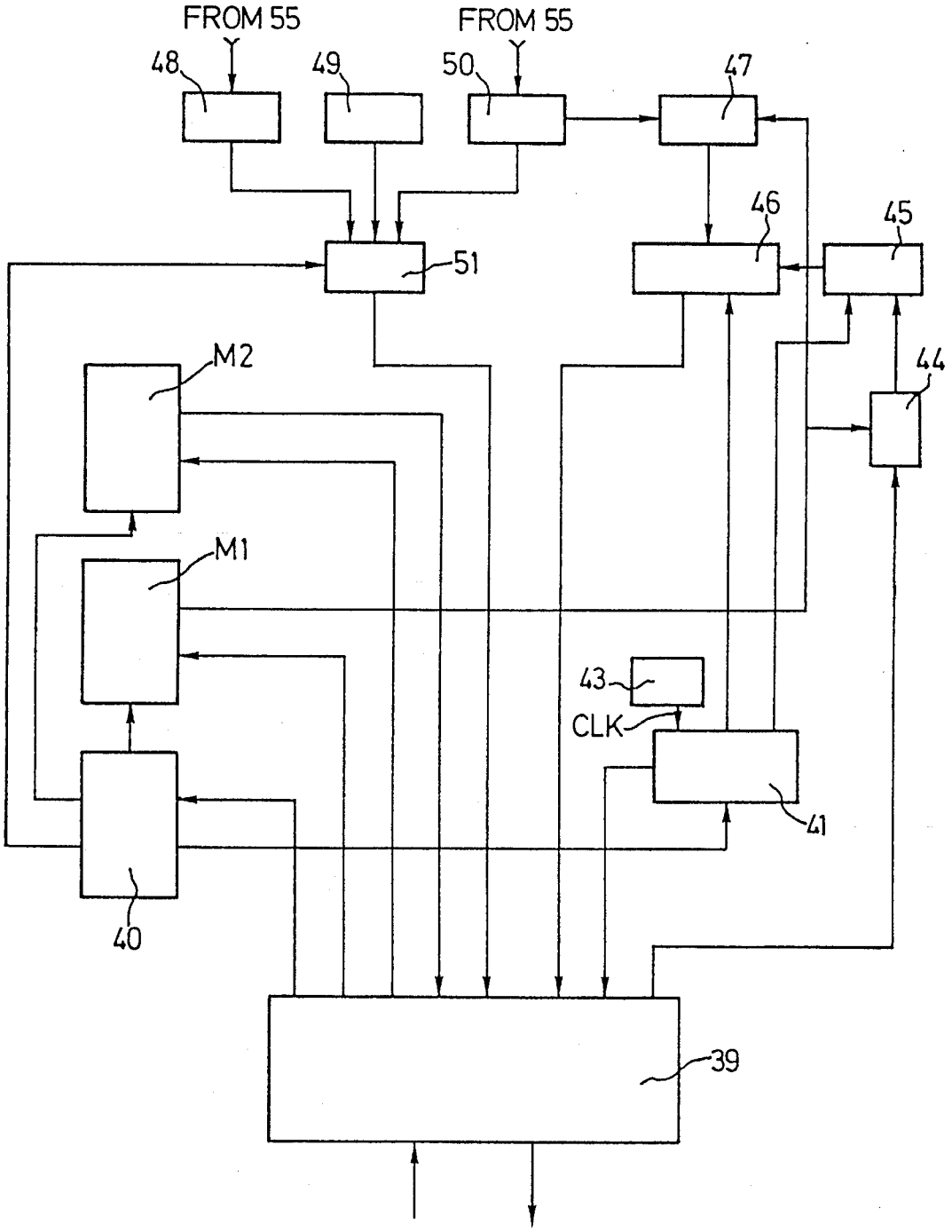
FIGS. 5, 6 and 7 represent block diagrams of the hard-wired architecture of an ASIC component incorporated the box.

FIG. 5 diagrammatically represents a part of the means incorporated within the component 37. First of all a series/parallel input/output register 39 is seen, forming part of the box input/output interface, and linked to the two copper regions 29 and 30. To this register 39 a decoder circuit 40 is linked, able to decode the various information items received by the register 39 (input/output, write, read). This decoder circuit 40 is linked to a shaper circuit 51, connected firstly to a state counter 48, such as a non-linear counter, capable of containing an item of state information representing the "lost" or "won" result of the game, secondly to a counter 49 capable of containing an item of information representative of a payment having actually been made to the player, and thirdly to a so-called win counter 50, such as a non-linear counter, able to contain an item of win information depending on the result of the game. In response to a status request, the shaper circuit is able to deliver the contents C1, C2, C3 of the three abovementioned counters 48, 49 and 50 to the input/output register 39.

The output of the win counter 50 is also linked to the input of a first logic circuit 47 whose other input is linked to a first random-access memory M1. The output of the first logic circuit is linked to a pseudo-random so-called win encryption generator 46, such as a polynomial counter or a cyclic generator, also controlled by an auxiliary counter 45 receiving, as input, the output of a second logic circuit 44 whose two inputs are linked respectively to the memory M1 and to the input output register 39. The output of the pseudo-random win encryption generator 46 is linked to the register 39.

Logic control means 41 for the whole of these means are also provided, timed by a clock signal CLK at a frequency of 500 kHz for example, delivered by an oscillator 43.

Another random-access memory M2, linked to the input/output register 39 forms part, with the memory M1, of the memory means of the box.

Figure 6:
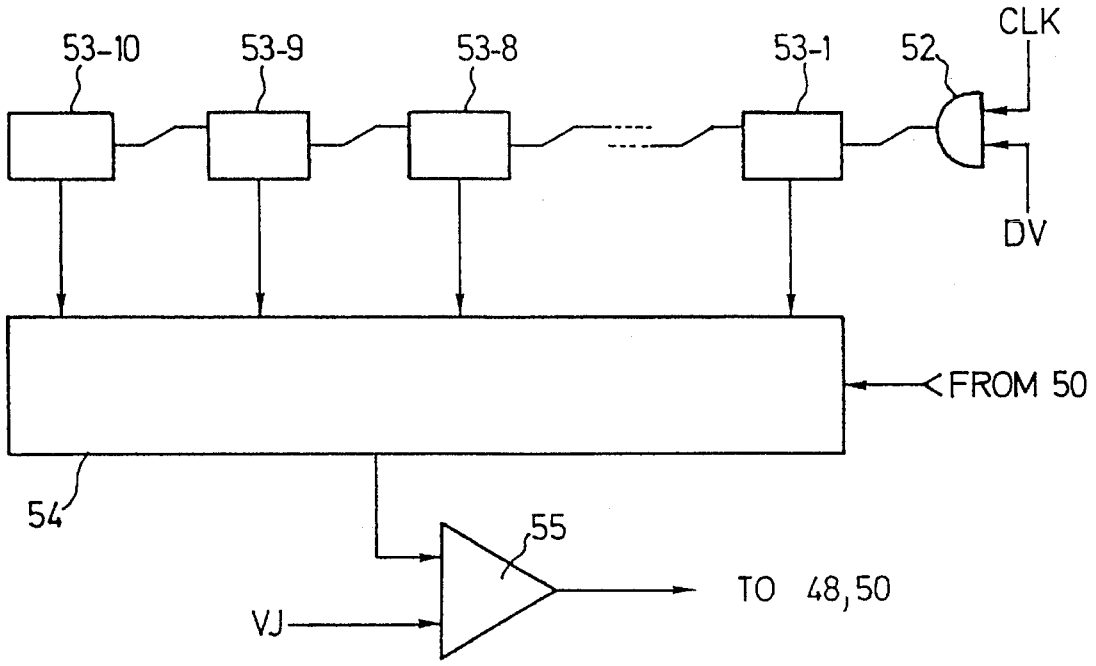
Figure 7:
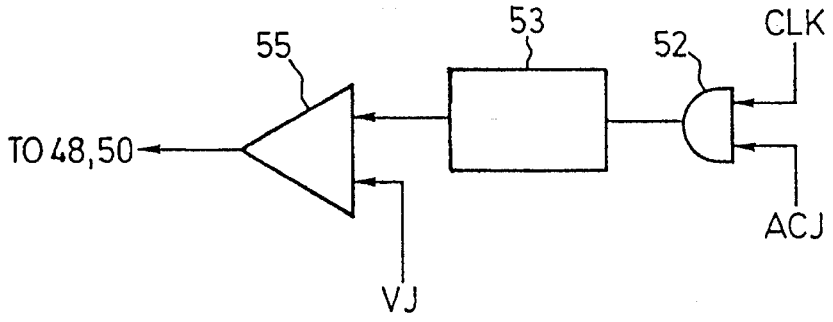
Figure 8:
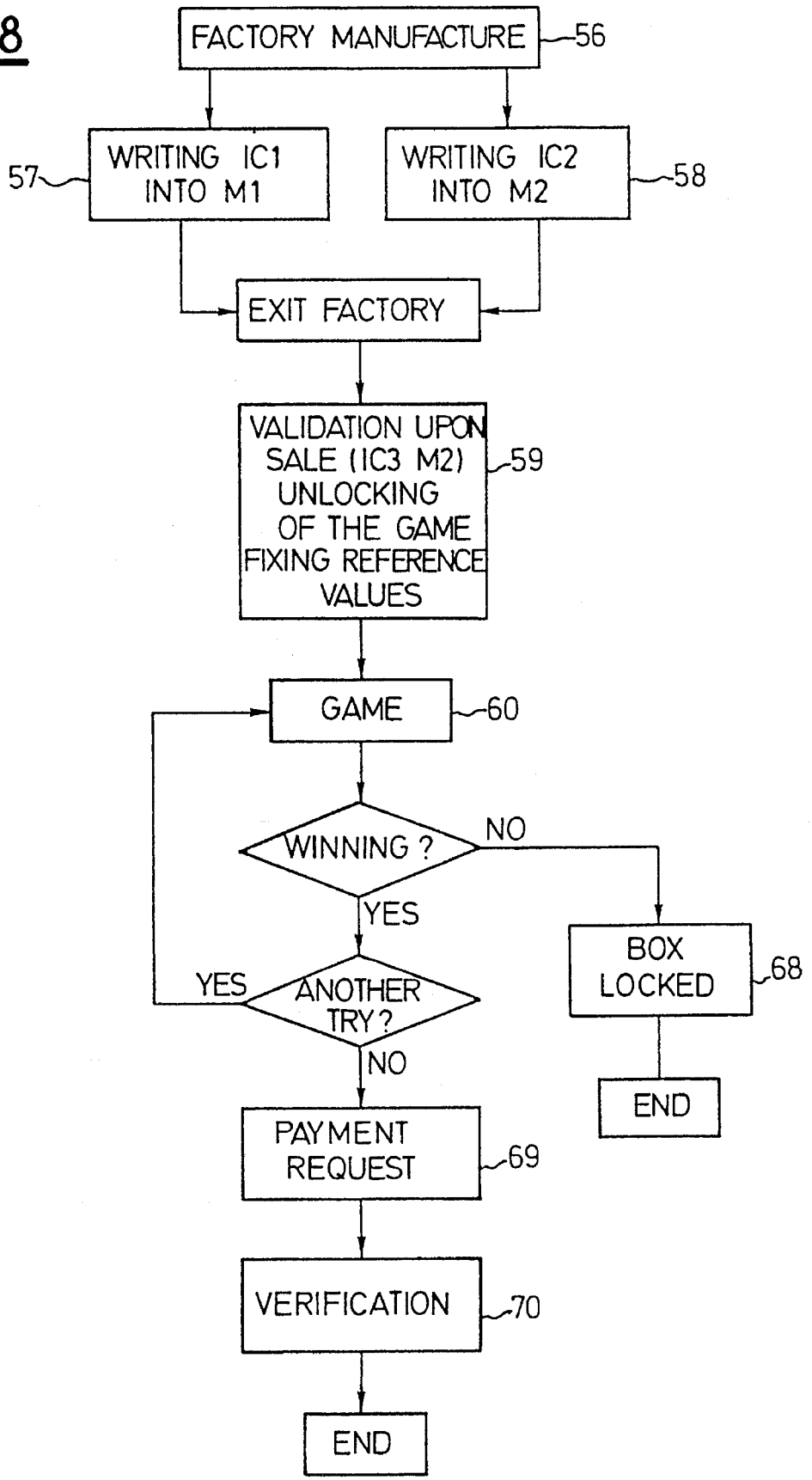
FIGS. 8, 9, 10*a*, 10*b*, 10*c* represent flow charts of the operation of the device and of implementing the game.

FIGS. 6 and 7 illustrate in more detail first random generation means able to generate reference data items which will be compared with the data items input by the player.

FIG. 6 represents an embodiment applicable to a draw, carried out once for a plurality of successive reference data items (ten for example) corresponding respectively to potential successive inputs of game data items by the player.

An AND logic gate 52 receives, as input, the clock signal CLK as well as an item of game authorization information DV the meaning of which will be returned to in more detail later. The output of this logic gate 52 is linked to the first modulo 2 counter (53-1) of a range of ten counters 53-1 to 53-10 linked in cascade to one another and whose outputs are linked respectively to the ten inputs of a multiplexer 54 the output of which is linked to the first input of a comparator 55. Each counter is therefore capable of displaying a content corresponding to one of the three FIGS. 1, 2 and 3. This multiplexer 54 is controlled, as far as the choice of its input channel is concerned, by the output of the win counter 50. The other input of the comparator 55 receives the value VJ of the game data item input by the player. The output of this comparator is linked to the state counter 58 and to the win counter 50.

As will be seen later, FIG. 7 illustrates an embodiment more particularly adapted either to successive draws associated respectively with successive inputs of game data items by the player, or to a random generation of a game data item which will be similar, for example, to a throw of a die on the part of the player. In this latter case, the reference data item which will be compared with the randomly generated game data item may be a constant stored in the memory means of the box. In this embodiment, the logic gate 52, in place of the game authorization information item DV receives the signal ACJ from inputting of a game data item by the player on the communication interface. Only one counter 53 is then provided, linked to this logic gate 52 and the output of which is linked to the first input of the comparator 55.

The operation of the device according to the invention will now be described in more detail, referring more particularly to FIGS. 8 to 10*c*.

During manufacture in the factory, (step 56) a first item of auxiliary data IC1 is written into the memory M1 while an item of authentication data IC2 is written into the memory M2 (step 57 and step 58). The first auxiliary data item IC1 constitutes a first security measure which will be used during actual payment of the win to the player. It results in a general way from a first auxiliary encryption of an item of information specific to the box. More precisely, it relates, for example, to an item of encrypted information obtained from the serial number NS of the box by an encryption algorithm of the secret-key type, such as that known by the acronym DES (Data Encryption Standard) and for this purpose using a first secret key. It will also be possible to use a public-key encryption algorithm such as that known by the acronym RSA (Rivest Shamir Arielman).

The authentication data item IC2 also consists of an authentication encryption of an item of information specific to the box. Physically, it relates to encryption of the serial number of the box from a secret-key (or possibly public-key) algorithm, with a key different to that used for the information item ICl. This data item IC2 is in fact a certificate of the serial number NS.

So as to preserve the contents of the random-access memories M1 and M2, the box will be powered by its power supply means permanently from its manufacture in the factory. That being so, the said counters 53-1 to 53-10 operate from the stage of manufacture of the box in the factory.

Nevertheless, at this stage, the box is unable to be played or locked. In other words, the box processing means are inactive and a player, who comes into possession of such a box, cannot insert game data with the aid of the keys 25–27.

On exit from the factory, the box is stored in a sales premises equipped with a control station 12. When such a box is sold to a player, validation of the latter is first of all carried out (step 59). The box being arranged on the system interface 17, the system processing means 16 carry out a reading of the contents of the memory M2, and the authentication encryption means 21 recalculate the authentication data item IC2, from the serial number NS and from the value of the secret key used (also present in the memory means of the station). To this effect, the system processing means may have knowledge of the serial number NS of the box, either by reason of its storage directly in the memory M2 of the box, or by optical reading with the aid of an appropriate reader, of the bar code situated on the rear face of the box. The agreement of the recalculated authentication data item with that which was present in the memory M2 before this validation step 59, makes it possible to carry out a first verification on the origin of the box and thus to be satisfied, a priori, that an authentic box is involved.

Once this verification of the origin has been carried out, the second auxiliary encryption means 20*b* of the system processing means determine a second item of encrypted auxiliary data IC3 also from an item of information specific to the station making the sale and of a secret (or possibly public) key encryption algorithm using a third key which is different from the first two. In practice, the second auxiliary encryption means use, as station-specific information item, its serial number, the date of the sale as well as the order number of this sale at this date, and determine the encrypted certificate of this station-specific information item. The system processing means then store this station-specific information item, as well as the certificate IC3, in the memory M2.

The agreement of the authentication data item IC2 stored in the memory M2, with that recalculated, also has the consequence of transmission, by the system processing means of the station, of the game authorization information item DV which has the effect, on the one hand, of activating the box processing means in order to make the box available for playing, and, on the other hand, of stopping the operation of the game counters 53-1 to 53-10. This game authorization information item as well as the status request are in fact specific commands transmitted by the station, and on reception of which the box processing means carry out predetermined operations. It is appropriate to note that, in this embodiment, the plurality of reference data items is then the plurality of values which the counters 53-1 to 53-10 had on reception of the game authorization information item. These reference data items are stored in the counters 53-1 to 53-10 with a view to their comparison with the game data items. The drawing of all the reference data items has thus been done a single time. Moreover, the rapid operating rate of the counters as well as the random character of the instant of setting the counters going at the manufacturing factory, and of the instant of reception of the DV information item contribute to the "random" nature of the generation of the reference data items.

Needless to say, in the variant illustrated in FIG. 7, relating to successive drawings of reference data items, the reception of the game authorization information item DV has the effect only of activation of the processing means of the box, and the unlocking of the latter so as to make it ready to be played.

The player is now in possession of a box with which he can play.

Figure 9:
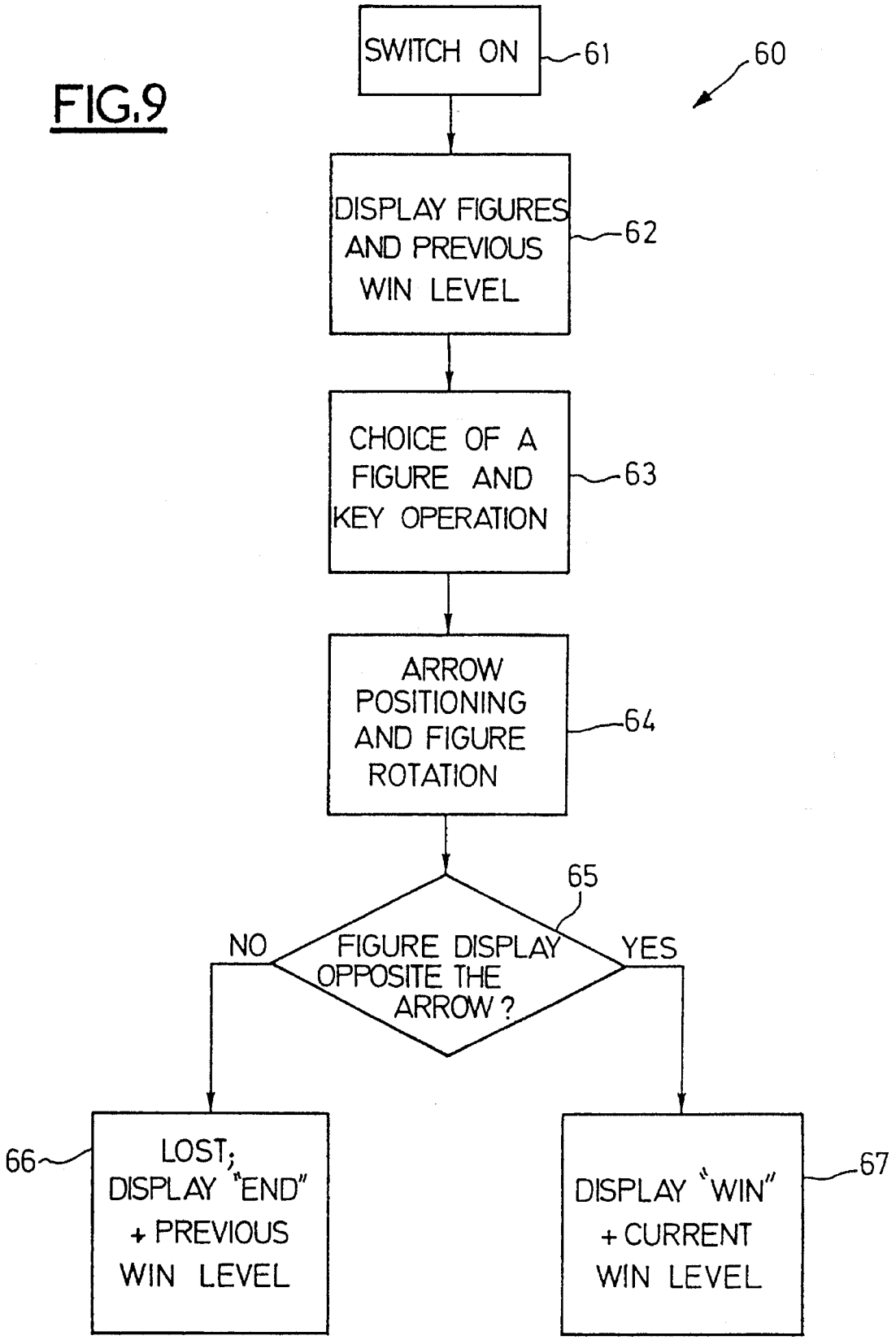

The game phase proper 60, here corresponding to a specific game example, is illustrated in more detail in FIG. 9. Upon setting the box in operation (step 61) by pressing on the key 24, the screen 28 displays (step 62) the FIGS. 1, 2 and 3 in the locations N1, N2 and N3 as well as the prior win level. If the player has never played with this box, there is, needless to say, no prior win level display.

At step 63, the player chooses a figure and actuates the corresponding key 25–27 which represents the inputting of his game data item. The arrow F, opposite the location N1, N2 or N3 corresponding to the figure chosen by the player is displayed and the box processing means then activate visual animation software, commonly known as "caterpillar" by the person skilled in the art, and having the effect of producing a rotation on the display screen 28 of FIGS. 1, 2 and 3, thus simulating the movement of a wheel in a game of roulette. The caterpillar next simulates the deceleration of the wheel and the figure corresponding to the reference data item contained in the first game counter 53-1 is displayed at the corresponding location on the display screen 28 (steps 64, 65).

If the figure is displayed opposite the arrow F which represents the game data item chosen by the player (step 67), the latter has won. In this case, the expression "WIN" displays at the location WI and the win level 1 is displayed at the location WL1. In the opposite case (step 66), that is to say if the figure corresponding to the reference data item is not displayed opposite the arrow F, the player has lost and the expression "END" is displayed in the location EN. In such a case, the box processing means lock (step 68) the interface for communication with the player, in the sense that the latter can no longer input a game data item with the aid of the keys 25–27. In other words, the box is again made unable to be played and can, for example, be discarded.

In the case of a winning game, the player has two possibilities. Either he decides to stop playing and to request the payment of his winnings by presenting himself at a station 12, or he decides to try his luck a further time by again choosing a game data item which he inputs with the aid of the keys 24–27. The progress of the game then again follows the steps 63 to 66 or 67. In the embodiment illustrated in FIG. 6, the contents of the win counter make it possible to select the input channel of the multiplexer 54 since this win counter includes a different item of win information for each winning try by the player. Hence, in the present case, during the second try, the second counter 53-2 of the chain will be selected and its contents corresponding to the second reference value will be compared with the game data item inserted by the player. The player can again try his luck ten times in a row in order to hope to reach win level 10. Upon each new winning try, his current win level is displayed and is higher than the preceding win level. In contrast, if in the course of this process, a try becomes losing, the box becomes unable to be played and the preceding win level remains displayed. Needless to say, the player can only attempt a subsequent try if he has succeeded at the preceding try, that is to say if there was agreement between the reference data item associated with his preceding try and the game data item which he had then input.

In the embodiment illustrated in FIG. 7, the ten reference data items corresponding to the ten win levels are not predetermined in advance. The counter 53 operates until one of the keys 24–27 is actuated by the player, representing his choice of a game data item. This action ACJ then freezes the counter 53 at a value defining the randomly generated reference value and associated with the inputting of the game data item by the player during his try. After the display of a possible winning result, the operation of the counter 53 carries on and the latter will be again fixed at another value upon possible subsequent inputting of another game data item by the player.

The variant of FIG. 7 is also compatible with another type of game consisting this time in comparing reference data items which are predetermined, constant and stored in memory, with game data items input randomly by the player. Thus a throw of dice by the player is simulated. In this case, the reception of the signal at ACJ, brought about by the actuation of an appropriate key on the box by the player, gives rise to stopping of the counter 53 representing the random generation of the game data item which will next be compared with the reference value (here also designated by VJ) stored in memory.

In the case in which a player having won and having reached a certain win level, decides not to play any longer and to request payment of this win, he then goes on to make a payment request 69 from a station 12 which will then go on to an in-depth verification phase 70. It is appropriate to note here that the player may request this payment from the same station which sold him his box or from another similar station.

Figure 10A:
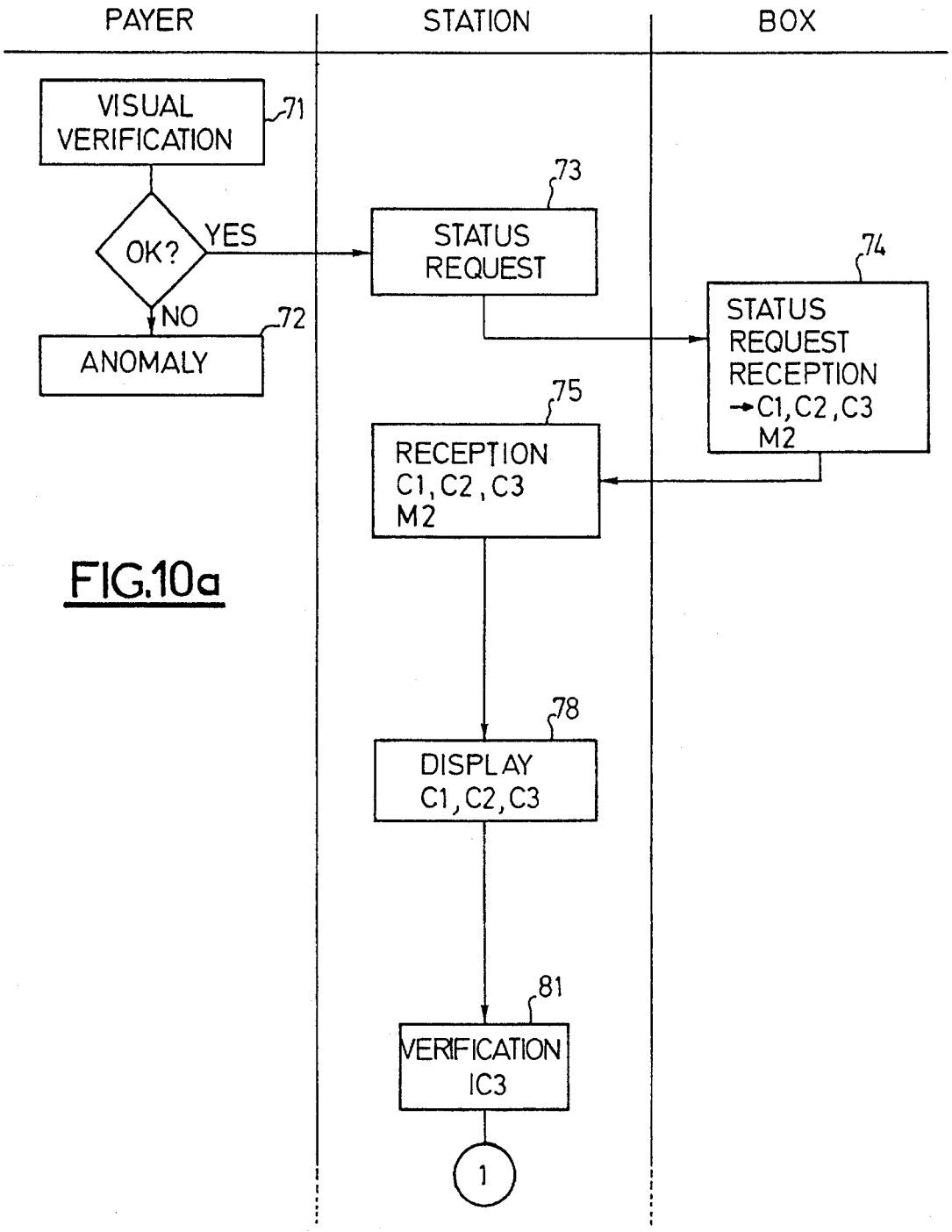
Figure 10B:
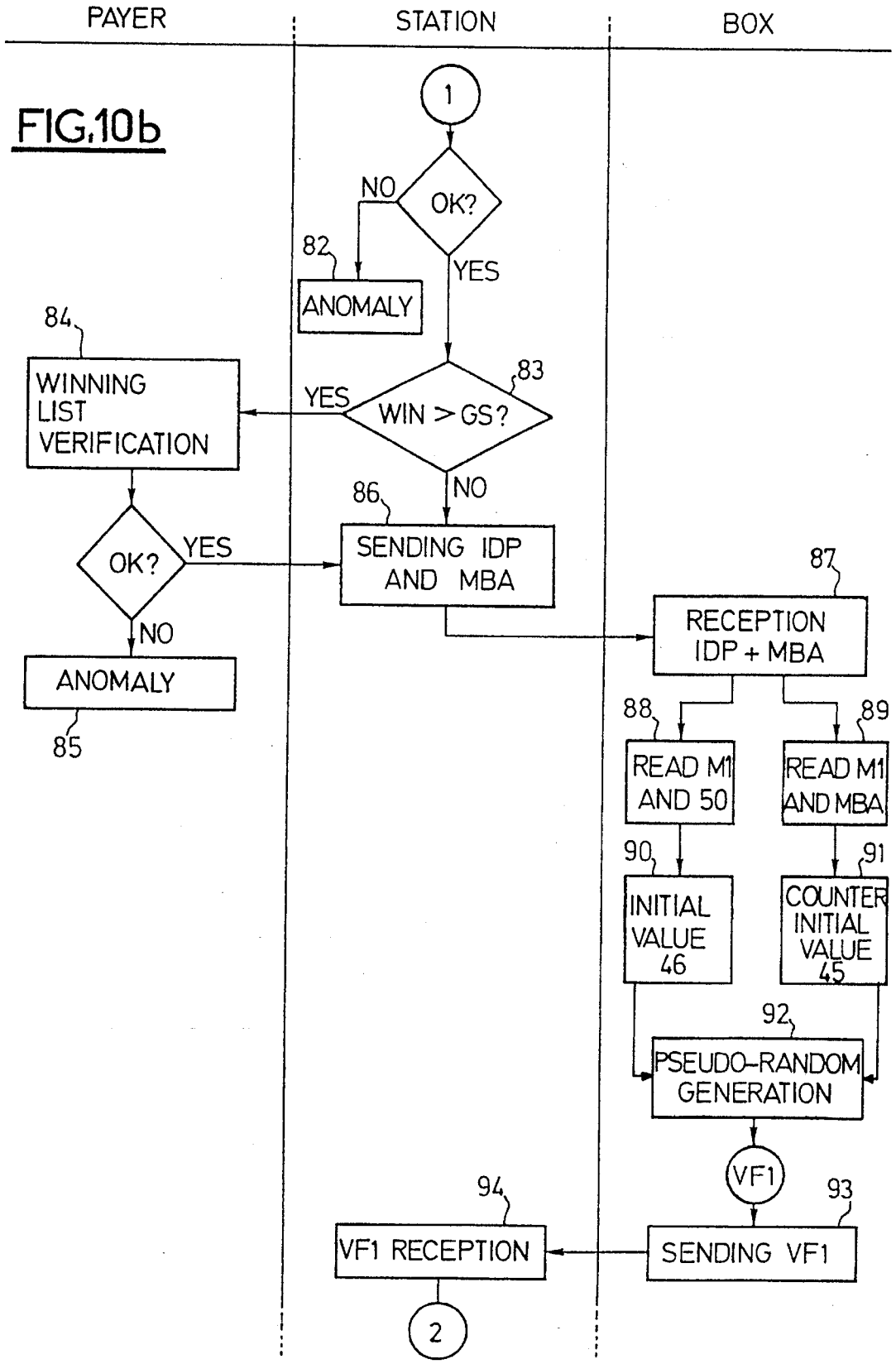
Figure 10C:
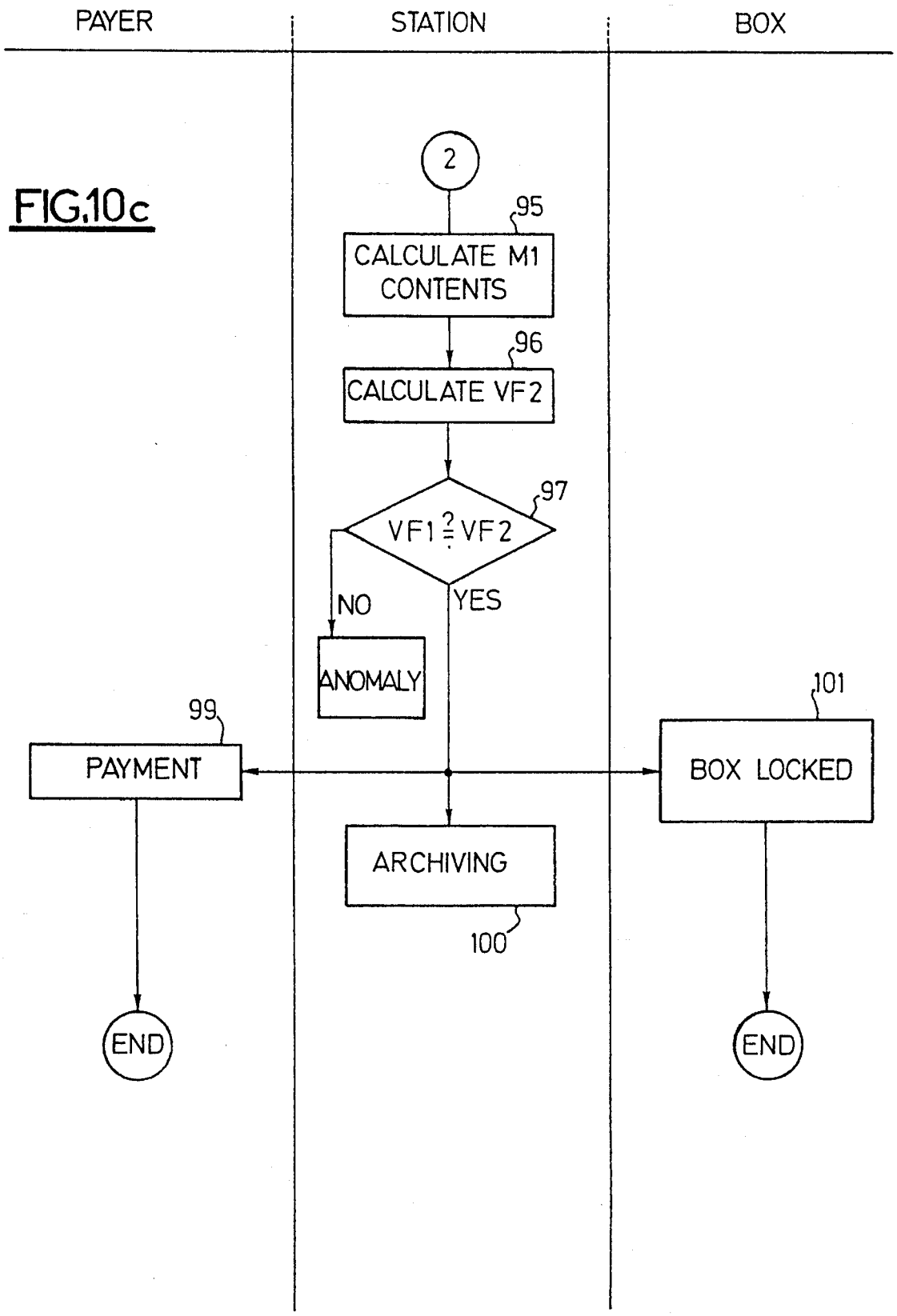

FIGS. 10*a* to 10*c* will now be referred to more particularly in order to describe this verification phase.

The latter first of all commences with the visual verification 71 on the part of the agent tasked with making the payment. This visual verification consists in verifying the display of the expression "WIN" as well as the display of a win level. If no anomaly 72 appears, the box is then placed on the input/output interface 17 of the station and the system processing means deliver a status request (step 73) to the box processing means. 0n reception 74 of this status request ST1, the box processing means deliver, to the input/output register 39, the respective contents C1, C2, C3 of the counters 48, 49 and 50, as well as the contents of the memory M2. The respective contents C1, C2, C3 are then displayed in "clear" on the screen 14 of the dialogue interface of the station (step 78). This constitutes another visual verification, not, however, constituting proof for the actual payment of the win to the player, as will be explained later.

A verification step 81 comes next, consisting in verifying the value of the second auxiliary data item IC3 contained in the memory M2. In order to do that, the second auxiliary encryption means 20b of the system processing means of the station read the station-specific information item (serial number of the station, date of sale and order number) in the memory M2, and recalculate the certificate IC3 of this specific information item in order to compare it with that contained in the memory M2.

A non-agreement in these two data items IC3 then leads to an anomaly 82 which can interrupt the payment process. In the opposite case, the system processing means compare the win information from the win counter 50 with a predetermined win value GS. If the win is higher than this value GS, the system processing means then check whether the authenticator of the box in question, 10 that is to say its serial number, is not already contained in the list of authenticators of winning, and already paid, boxes. If such were the case, there would again be an anomaly 85 interrupting the payment process. If the station 12 is not linked to the means 23 of storage of this list, the player is then asked to make his way to a station linked to this list. Needless to say, the player can be asked to change station just after the visual verification 71.

In the case in which either the win is lower than the value GS, or the win is higher than the value GS and the box is not on the winning list, the system processing means then send out (step 86) an item of payment request information IDP accompanied by a random binary word MBA. On reception 87 of the information item IDP and of the binary word MBA, by the input/output interface of the box, the encryption means (44, 45, 46, 47) of the box are able to generate a first encrypted win value VF1 from the win information contained in the win counter 50 and from the first auxiliary data item IC1 contained in the memory M1 (steps 88–92).

In order to do that, the pseudo-random win encryption generator 46 is able to be initialized by an initial value and to operate until reception of a stop indication. The first encrypted win value VF1 is then the value delivered by the pseudo-random win encryption generator 46 upon reception of this stop indication.

The first logic circuit 47 receives, as input variable, the win information contained in the win counter 50 and a part of the first auxiliary data item IC1 stored in the memory Mi. This first circuit 47 then applies a first predetermined logic function, for example based on exclusive-OR, to these two input variables and delivers a first corresponding output value, which defines the initial value of the pseudo-random win encryption generator 46.

The auxiliary counter 45 is able to count up or count down from a counter initial value to a counter final value. The indication of stopping the operation of the pseudo-random win encryption generator is then delivered by the auxiliary counter 45 when the said counter final value is reached.

The second logic circuit 44 is used here to define the counter initial value or the counter final value according to whether the counter is counting up or counting down.

This second logic circuit receives as input variables the pseudo-random binary word MBA and a second part of the first auxiliary stored data item ICl. A second predetermined logic function, preferably different from the first, is then applied to these two input variables and the second logic circuit 44 delivers a second output value which defines the counter initial value or the counter final value.

Hence, the polynomial counter (for example) 46 is initialized to an initial value depending on the encrypted contents of the memory M1 and of the win information item contained in the win counter 50. This counter will then operate until the auxiliary counter 45 stops, the number of iterations of the latter being defined pseudo-randomly with the aid of the binary word MBA. Upon the stopping of the counter 46, its contents, defining the first encrypted win value VF1 is delivered to the system processing means of the station via the input/output register 39 (steps 93, 94).

The actual payment of the win to the player will be made only if this first encrypted win value VF1 delivered by the box is identical to a second encrypted win value VF2 established by the system encryption means 19 of the station. To this end, the first auxiliary encryption means 20a of the station recalculate the first auxiliary encrypted data item IC1 from the serial number of the box and from the corresponding secret key. This serial number can be stored in the memory M1 or also read optically by an optical reader. From that, the system encryption means, including means analogous to those of the box encryption means (that is to say logic circuits and counters analogous to the logic circuits 44, 47 and to the counters 45 and 46), calculate the second encrypted win value, in a manner analogous to that used for the calculation of the first encrypted win value VF1, on the basis of the information item IC1 recalculated by the first auxiliary encryption means, and of the pseudorandom binary word MBA which is known to the station since it is generated by the system pseudo-random generation means 22.

In the event of non-agreement, there is again an anomaly interrupting the payment process. In contrast, in the event of agreement, the payment 99 of the win is made to the player, the box is locked (step 101), the counter 49 is loaded by an information item representing a payment made to the player and an archiving of the serial number of this winning box is carried out (step 100) either within the station itself or within storage means 23 especially if it relates to a win higher than the value GS.

The conditioning of the actual payment of the win to the player by the agreement of two encrypted win values VF1 and VF2 guarantees the paying body against fraud originating especially from counterfeit boxes containing microprocessors programmed to simulate dummy values of win information items.

Although the other verification steps (status request, verification of the data items IC2 and IC3) are not indispensable, they contribute advantageously to enhancing security against fraud. Moreover, the person skilled in the art will have understood that only the content of the counters 48, 49 and 50 constitutes proof to the paying body, the display of their contents on the screen 14 or 28 being only a visual indication. Thus, still with the aim of enhancing security, it is advantageously provided for the win counter 50 to be arranged to contain successively predetermined win binary words representing successive win information items which the player can obtain if he wins successively on each try. Each binary word thus differs from the preceding word and from the following word in the list by at least two bits. Such a precaution further complicates the task of a fraudster who might desire to modify the contents of the win counter as he would have to modify two bits at once and not one.

The same precaution may advantageously be used for the state counter 48 with a second predetermined list of binary words differing from one another by at least two bits. This moreover contributes double security for verifying the win level obtained and the lost or winning state of the game at each try.

Finally it is possible for a player to want to buy a box from a third person in order to continue the game. In this case, it is particularly advantageous that the purchaser can verify the contents of the win counter in particular. Hence, in the presence of a request for verification of win information originating from the purchasing player, the system processing means are able to read the contents of the win, state and payment counters and to impart the results of this reading on the screen 14 of the dialogue interface. Needless to say, in this case, the payment request information item IDP is not delivered to the box.

We claim:

1. An electronic game of chance comprising:

a portable box containing:

box interface means for receiving a predetermined game authorization information item required for a game to be played and for receiving a payment request information item;

communication means for communicating with the player;

means for determining reference data item internally within said box;

memory means for storing at least one reference data item a box processor including box comparison means for comparing said reference data item with a game data item communicated by the player via said communication means, one of these two data items being a value generated within said portable box by a first random generator means win detection means, responsive to said box comparison means, for establishing a win information item depending at least on the result of said comparison, and for storing said win information item in said memory means, and box encryption means, responsive to said payment request information item, for establishing a first encrypted win value from said win information item and for delivering said first encrypted win value to said box interface means; and a control system external to said portable box containing:

a system input/output interface and a system processor including means, responsive to a payment request originating from the player, for reading said win information item contained in said memory means of said portable box and for delivering said payment request information item to said system input/output interface, system encryption means for establishing a second encrypted win value from said win information item, and system comparison means for comparing said two encrypted win values to control payment in response to said payment request.

2. The system of claim 1, wherein said system processor further comprises:

means for transmitting said predetermined game authorization information item to said box interface means.

3. The system of claim 1 wherein said box processor further comprises:

first random generation means for randomly providing said reference data item from among a predetermined set of values; and wherein said communication means further comprises:

data inputting means for allowing the player to select said game data item from said predetermined set of values.

4. The system of claim 3 wherein said first random generation means further comprises:

game counter means for producing a series of values and for storing one of said values as said reference data item in response to receipt of a stop information item.

5. The system of claim 4 wherein said stop information item is said game authorization information item.

6. The system claim 3, wherein said first random generation means further comprises:

a plurality of game counters, each game counter having means for storing one of said reference data items, each of said reference data items being associated with a game data item input by the player.

7. The system of claim 6, wherein each of said plurality of game counters further comprises:

means for stopping said counter at a stopped value upon receiving said predetermined game authorization information item and for setting a corresponding reference data item to said stopped value.

8. The system of claim 1, wherein said box processor further comprises:

second random generation means for randomly providing said game data item in response to an action of the player.

9. The system of claim 1 wherein said memory means stores a predetermined first auxiliary data item, and wherein said box encryption means establishes said first encrypted win value from said win information item and from said predetermined first auxiliary data item.

10. The system of claim 9, wherein said predetermined first auxiliary data item is present in said memory means before reception of said game authorization information item, and said box encryption means further comprises:

first auxiliary box encryption means for encrypting a first portable box specific information item to determine said first auxiliary data item.

11. The system of claim 10, wherein said system processor further comprises:.

first auxiliary system encryption means for encrypting said first portable box specific information item for determining a recalculated first auxiliary data item, and wherein said system encryption means produces said second encrypted win value from said recalculated first auxiliary data item.

12. The system of 11 wherein said system processor further comprises:

means for generating a pseudo-random binary word, and wherein said system encryption means produces said second encrypted win value from said pseudo-random binary word in addition to said recalculated first auxiliary data item and said win information item.

13. The system of claim 9, wherein said box encryption means further comprises:

auxiliary counting means for counting up or counting down from a counter initial value to a counter final value and for producing a stop indication when said counter final value is reached;

first logic circuit means responsive to said win information item and to at least a part of said first auxiliary stored data item for producing an initial value; and pseudo-random win encryption generating means for operating from said initial value until receiving said stop indication to produce said first encrypted win value.

14. The system of claim 13, wherein said box encryption means further comprises:

second logic circuit means responsive to a pseudorandom binary word and at least a second part of said first auxiliary data item for producing said counter initial value or said counter final value.

15. The system of claim 1, wherein said memory means further stores a second auxiliary data item, and wherein said system processor further comprises:

verification means for verifying the value of said predetermined second auxiliary data item before said system processor delivers said payment request information item to said portable box in response to said payment request.

16. The system of claim 15, wherein said verification means further comprises:

second auxiliary encryption means for encrypting a second portable box specific information item to determine said second auxiliary data item in response to receiving said game authorization information item from said portable box, means for storing said second portable box specific information item and said predetermined second auxiliary data item in said memory means of said portable box, and said second auxiliary encryption means further comprises:

means for reading said second portable box specific information item and said predetermined second auxiliary data item from said memory means of said portable box, and means for producing a recalculated second auxiliary data item from the second portable box specific information item read from said memory means, and means for comparing the value of said second auxiliary data item read from the memory with said recalculated second auxiliary data item.

17. The system of claim 1, wherein said memory means further comprises:

means for storing a portable box authentication data item, and wherein said box processor further comprises:

means for verifying said portable box authentication data item before receiving said game authorization information item.

18. The system of claim 17, wherein said means for verifying said portable box authentication data item further comprises:

authentication encryption means for verifying the value of a third portable box specific information item read from said memory means by calculating said portable box authentication data item from said third portable box specific information item.

19. The system of claim 18, wherein said authentication encryption means include key encryption algorithms, and said second auxiliary data item and said portable box authentication data item are encrypted certificates of said second and third portable box specific information items.

20. The system of claim 18, wherein said third portable box specific information item further comprises a serial number specific to said portable box, and wherein said system processor further comprises:

means for reading said serial number from said portable box.

21. The system of claim 1, wherein said memory means further comprises:

first memory means for storing said first auxiliary data item; and second memory means for storing said portable box authentication data item and then, after verification of the said portable box authentication data item, for storing said predetermined second auxiliary data item.

22. The system claim 1, wherein said memory means further comprises:

state counter means for storing an item of state information representing a result of playing the game; and payment counter means for storing a payment information item representing a payment already made or not yet made to the player; and wherein said system processor further comprises:

means, responsive to a player's payment request, for reading said state counter means and said payment counter means before delivering said payment request information item to said portable box.

23. The system of claim 22, wherein said state counter means further comprises:

means for successively storing predetermined binary state words representing successive state information items, each binary state word differing from the following word and from the preceding word by at least two bits.

24. The system of claim 22, wherein said memory means further comprises:

a win counter for storing win information items; and said system processor further comprises:

means, responsive to a win information item verification request from the player, for reading said win, state and payment counters and for communicating the results of said reading to the player.

25. The system of claim 1, wherein said portable box further comprises:

power supply means for allowing the operation of at least some of the portable box's means before reception of the game authorization information item.

26. The system of claims 1 wherein said portable box further comprises:

first means for rendering the portable box unplayable in response to a comparison between said reference data item and said game data item indicating a losing game; and second means for rendering the portable box unplayable after actual payment to the player.

27. The system of claim 1, wherein said communication means further comprises:

means, responsive to said box comparison means, for displaying to the player a result information item indicating whether the game was won or lost.

28. The system of claim 27, wherein said result information item further comprises:

an item of win level information corresponding to said win information item contained in said memory means.

29. The system of claim 1, wherein said memory means further comprises:

means for storing a plurality of reference data items; and said box comparison means further comprises:

means for comparing a plurality of game data items communicated by the player.

30. The system of claim 29, wherein said game data items are input successively, and said communication means further comprises:

means responsive to a newly input game data item only if said comparison between the previously input game data item and one of said plurality of predetermined reference data items corresponding thereto indicates agreement.

31. The system of one of claims 29, wherein said first random generation means further comprises:

a plurality of game counters each having means, responsive one of said game data items input by the player, for fixing said game counter at a value associated with said game data item.

32. The system of claim 1, wherein said memory means further comprises:

a win counter for successively storing predetermined binary win words representing successive win information items, each binary word differing from the following word and the preceding word by at least two bits.

33. The system of claim 1, wherein said control system further comprises:

control system communication means for receiving said payment request from the player.

34. The system of claim 1, wherein said system processor further comprises:

means, responsive to said payment request originating from the player, for transmitting a status request to said system input/output interface; and wherein said box processor further comprises:

means for delivering said win information item to said box interface means in response to said status request.

35. The system of claim 1, wherein said control system further comprises:

a plurality of stations of similar structure, each station including means for delivery of said game authorization information item, for delivery of said payment request information item to said portable box receiving said game authorization from said station and for delivery of said payment request information to said portable box receiving said game authorization from a different one of said stations.

36. The system of claim 1, further comprising:

a plurality of additional portable boxes each possessing a authentication unique thereto; and said control system further comprises:

storage means for storing a list of authenticators relating to said portable boxes; and means, responsive to the presence of a payment request originating from the player of a particular portable box corresponding to a win higher than a predetermined win value, for verifying the authenticator of said particular portable box in said list of authenticators.

* * * * *